US008021491B2

(12) United States Patent
Kool et al.

(10) Patent No.: US 8,021,491 B2
(45) Date of Patent: Sep. 20, 2011

(54) METHOD FOR SELECTIVELY REMOVING COATINGS FROM METAL SUBSTRATES

(76) Inventors: Lawrence Bernard Kool, Clifton Park, NY (US); Michael Howard Rucker, Cincinnati, OH (US); David Edwin Budinger, Loveland, OH (US)

( * ) Notice: Subject to any disclaimer, the term of this patent is extended or adjusted under 35 U.S.C. 154(b) by 0 days.

(21) Appl. No.: 12/484,704

(22) Filed: Jun. 15, 2009

(65) Prior Publication Data

US 2009/0261068 A1 Oct. 22, 2009

Related U.S. Application Data

(63) Continuation-in-part of application No. 11/635,342, filed on Dec. 7, 2006, now abandoned.

(51) Int. Cl.
*C23G 1/02* (2006.01)

(52) U.S. Cl. ..... 134/2; 134/3; 134/26; 134/28; 134/30; 134/41; 134/42; 216/83; 216/96; 216/102; 216/103; 216/104; 427/250; 427/255.34; 427/307; 427/309; 427/337

(58) Field of Classification Search ..... 134/2, 3, 134/26, 28, 30, 41, 42; 216/83, 96, 102, 216/103, 104; 427/250, 255.34, 307, 309, 427/337
See application file for complete search history.

(56) References Cited

U.S. PATENT DOCUMENTS

| | | | | |
|---|---|---|---|---|
| 6,036,995 | A * | 3/2000 | Kircher et al. | 427/142 |
| 6,355,116 | B1 * | 3/2002 | Chen et al. | 148/280 |
| 6,599,416 | B2 * | 7/2003 | Kool et al. | 205/717 |
| 6,833,328 | B1 * | 12/2004 | Kool et al. | 438/745 |
| 2002/0090527 | A1 * | 7/2002 | Thompson et al. | 428/553 |
| 2002/0100493 | A1 * | 8/2002 | Kool et al. | 134/3 |
| 2002/0136824 | A1 * | 9/2002 | Gupta et al. | 427/142 |
| 2002/0155316 | A1 * | 10/2002 | Zheng | 428/678 |
| 2003/0062271 | A1 * | 4/2003 | Kool et al. | 205/717 |
| 2003/0083213 | A1 * | 5/2003 | Kool et al. | 510/175 |
| 2003/0183247 | A1 * | 10/2003 | Kool et al. | 134/3 |
| 2004/0074783 | A1 * | 4/2004 | MacDonald et al. | 205/674 |
| 2004/0074873 | A1 * | 4/2004 | Kool et al. | 216/109 |
| 2004/0169013 | A1 * | 9/2004 | Kool et al. | 216/96 |
| 2004/0180232 | A1 * | 9/2004 | Das et al. | 428/610 |
| 2005/0031781 | A1 * | 2/2005 | Kool et al. | 427/240 |
| 2005/0115926 | A1 * | 6/2005 | Kool et al. | 216/109 |
| 2007/0151948 | A1 * | 7/2007 | Kool et al. | 216/83 |

FOREIGN PATENT DOCUMENTS

EP 1162286 * 12/2001

* cited by examiner

*Primary Examiner* — Bibi Carrillo
(74) *Attorney, Agent, or Firm* — Penny A. Clarke

(57) ABSTRACT

A method for selectively removing an aluminum-poor overlay coating from a substrate of a component, which as a result of its low aluminum content is highly resistant to a selective stripping solution. The method entails diffusing aluminum into the overlay coating to form an aluminum-infused overlay coating having an increased aluminum level in at least an outer surface thereof. The diffusion step is carried out so that the increased aluminum level is sufficient to render the aluminum-infused overlay coating removable by selective stripping. The outer surface of the aluminum-infused overlay coating is then contacted with an aqueous composition to remove the aluminum-infused overlay coating from the substrate. The aqueous composition includes at least one acid having the formula $H_xAF_6$, and/or precursors thereof, wherein A is Si, Ge, Ti, Zr, Al, and/or Ga, and x is from 1 to 6.

5 Claims, 1 Drawing Sheet

METHOD FOR SELECTIVELY REMOVING COATINGS FROM METAL SUBSTRATES

CROSS REFERENCE TO RELATED APPLICATIONS

This is a continuation-in-part patent application of co-pending U.S. patent application Ser. No. 11/635,342, filed Dec. 7, 2006, now abandoned. The contents of this prior application are incorporated herein by reference.

BACKGROUND OF THE INVENTION

The present invention is generally directed to methods of removing a coating from a substrate. More particularly, the invention relates to the removal of coatings poor in aluminum (Al) content from a metal substrate, e.g., a superalloy component.

A variety of coatings are used to provide oxidation resistance and thermal barrier properties to metal articles, such as turbine engine components. Coatings currently used on components of gas turbine hot sections, such as blades, nozzles, combustors, and transition pieces, generally belong to one of two classes, diffusion coatings and overlay coatings. State-of-the-art diffusion coatings are generally formed to contain aluminide intermetallics, such as nickel-aluminide, platinum-aluminide, or nickel-platinum-aluminide. Diffusion coatings are formed by depositing constituents of the coating on the component and reacting those constituents with elements from the underlying substrate of the component to form the coating by high temperature diffusion. Overlay coatings typically have the composition MCrAl(X), where M is an element from the group consisting of Ni, Co, Fe, and combinations thereof, and X is an element from the group consisting of Y, Ta, Si, Hf, Ti, Zr, B, C, and combinations thereof. In contrast to diffusion coatings, overlay coatings are generally deposited intact, without reaction with the underlying substrate. During high temperature exposure in air, including the operating conditions within a gas turbine engine, the aluminum contents of these aluminum-based coatings forms a protective aluminum oxide (alumina) scale. Though as a result the aluminum content of the coating is depleted to some degree, the alumina scale advantageously inhibits further oxidation of the coating and the underlying substrate.

It is also known to form a diffusion aluminide coating in the surface of an overlay coating to increase the amount of aluminum available for oxidation, and thereby increase the oxidation resistance of the coating. For example, U.S. Published Patent Application No. US2002/0155316 to Zheng teaches diffusing aluminum into an MCrAl(X) coating containing less than ten weight percent aluminum. The resulting surface region of the MCrAl(X) coating contains aluminum at a higher concentration than the aluminum concentration in the original MCrAl(X) coating. As evident from Zheng, the purpose of the diffusion-aluminided coating is to promote the environmental resistance of a component during engine operation. As such, following the coating process, the component is placed in service with the diffusion-aluminided MCrAl(X) coating present on its surface so that the component is able to take advantage of the improved protection offered by the coating during engine operation.

When a gas turbine is serviced, the protective coatings present on various components of the turbine usually must be removed to permit inspection and possible repair of the underlying substrate. Removal of the coatings is typically carried out by immersing the components in a stripping solution. A variety of stripping techniques are currently available for removing different types of coatings from metal substrates. The techniques usually must exhibit a considerable amount of selectivity to remove only intended materials, while generally preserving the components' desired structures.

Methods have been previously described for selectively removing Al-based coatings by contacting the coating with an aqueous composition which comprises an acid having the formula $H_xAF_6$. Usually, A is selected from the group consisting of Si, Ge, Ti, Zr, Al, and Ga, and x is 1 to 6. These methods have generally been effective in selectively removing Al-based overlay coatings and diffusion coatings from substrate materials. Particular examples include the aqueous compositions disclosed in U.S. Pat. No. 6,833,328, U.S. Published Patent Application No. 2002/0100493, and EP 1162286. Example 2 reported in U.S. Pat. No. 6,833,328 describes the stripping of a diffusion-aluminided MCrAlY from a coupon that had been removed from a gas turbine bucket. The bucket had previously been in service on a gas turbine engine, and as such the diffusion-aluminided MCrAlY coating had been subjected to thermal exposure and thermal cycles for a considerable period of time, resulting in a protective alumina scale on the surface of the coating. Similarly, Example 1 in U.S. Published Patent Application No. 2002/0100493 reports the stripping of another diffusion-aluminided MCrAlY coating on a gas turbine bucket that had seen engine service, and therefore had a protective alumina scale ("oxide formation") on its surface. As such, prior art such as the three documents identified above disclose the coating a component with an overlay (MCrAlX) coating, diffusion aluminiding the overlay coating, placing the component in service, and then subsequently removing the component from service and stripping its protective diffusion-aluminided overlay coating.

It has been recognized that MCrAl(X) coatings with less than about 12% Al by weight can have better high temperature (for example, in the 2000-2100° F. (about 1090-1150° C.) range) creep and stress rupture resistance than those with higher Al content (12% by weight or more), resulting in more use of MCrAl(X) coatings with less than about 12% Al by weight. These Al-poor (less than 12% Al by weight) coatings, however, are highly resistant to the selective stripping methods described above (aqueous compositions containing an acid having the formula $H_xAF_6$). Without an effective selective stripping process to remove these Al-poor coatings, non-selective methods must be relied on, such as very strong non-selective acids or aggressive mechanical methods, both of which can cause damage to the substrate. To reduce the risk of damaging the substrate during the process of coating removal, what is needed is an effective method for selectively removing Al-poor coatings from the substrate.

BRIEF DESCRIPTION OF THE INVENTION

Embodiments of the present invention provide a method for selectively removing an Al-poor (less than 12% Al by weight) overlay coating from a substrate, which as a result of its low aluminum content is highly resistant to stripping with $H_xAF_6$-based stripping solutions. The method is particularly effective for removing aluminum-containing overlay coatings from substrates of gas turbine components, which as a result from operation of the gas turbine has a protective alumina scale on an exposed outer surface of the overlay coating.

According to a first aspect of the invention, the method entails diffusing aluminum into the overlay coating to form an aluminum-infused overlay coating having an increased aluminum level in at least an outer surface thereof. The diffusion step is carried out so that the increased aluminum level is sufficient to render the aluminum-infused overlay coating removable by selective stripping. The outer surface of the aluminum-infused overlay coating is then contacted with an aqueous composition to remove the aluminum-infused overlay coating from the substrate. The aqueous composition includes at least one acid having the formula $H_xAF_6$, and/or precursors thereof, wherein A is Si, Ge, Ti, Zr, Al, and/or Ga, and x is from 1 to 6.

According to another aspect of the invention, the component is a gas turbine component and the method entails removing the component from the gas turbine after operation of the gas turbine and after growth of the protective alumina scale on the exposed outer surface of the overlay coating. Following removal of the component, aluminum is diffused into the overlay coating to form an aluminum-infused overlay coating having an increased aluminum level in at least its outer surface. The diffusing step is carried out so that the increased aluminum level is sufficient to render the aluminum-infused overlay coating removable by selective stripping. The outer surface of the aluminum-infused overlay coating is then contacted with an aqueous composition to remove the aluminum-infused overlay coating from the substrate. The aqueous composition includes at least one acid having the formula $H_xAF_6$, and/or precursors thereof, wherein A is Si, Ge, Ti, Zr, Al, and/or Ga, and x is from 1 to 6.

In view of the above, whereas the prior art has utilized aluminum diffusion of an overlay coating to yield a diffusion-aluminided overlay coating having improved oxidation resistance for subsequent placement in an oxidizing environment (for example, the hot gas flow path of a gas turbine), the present invention utilizes aluminum diffusion of an overlay coating for the sole purpose of stripping the overlay coating, for example, after the component protected by the overlay coating has already been exposed to an oxidizing environment and the overlay coating is to be removed to permit inspection and repair of the component.

Other aspects and advantages of this invention will be better appreciated from the following detailed description.

DETAILED DESCRIPTION OF THE INVENTION

Figure 1:
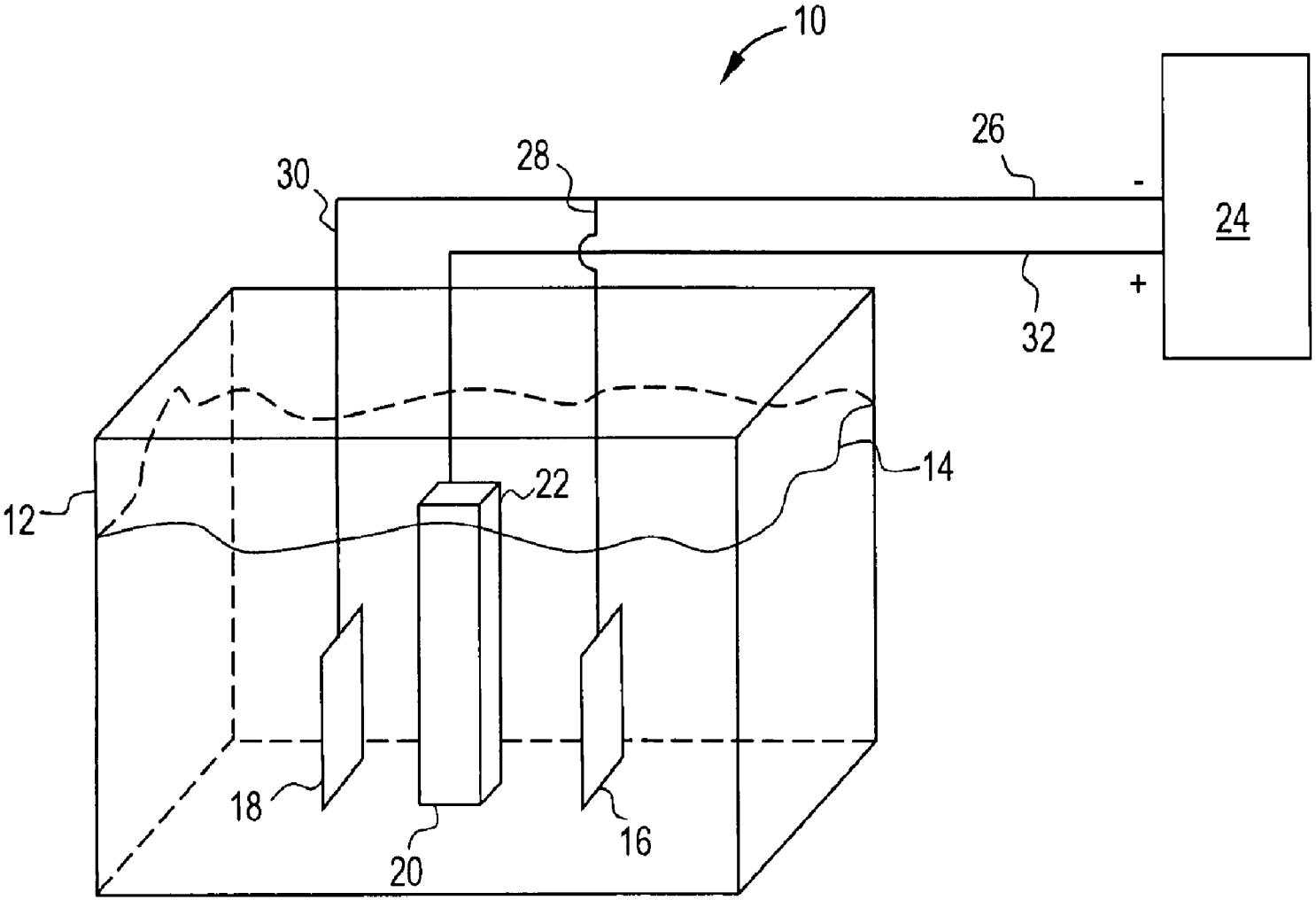
FIG. 1 is an illustration of a selective stripping system constructed in accordance with an embodiment of the invention.

As described above, aluminum-poor coatings, for example those having the composition MCrAl(X), where M is Ni, Co and/or Fe and X is Y, Ta, Si, Hf, Ti, Zr, B, and/or C, and where an Al content is less than about 12% by weight, are highly resistant to known selective stripping methods. By diffusing additional Al into such Al-poor overlay coatings to achieve an aluminum content of 12% by weight or more, it has been determined that the previously stripping-resistant Al-poor coating can be made removable, particularly if removed by selective stripping processes of the type disclosed by U.S. Pat. No. 6,833,328, U.S. Published Patent Application No. 2002/0100493, and EP1162286. As disclosed below, the invention utilizes aluminum diffusion of an Al-poor overlay coating for the sole purpose of stripping the overlay coating from a substrate. While the invention will be particularly described as being useful for removing an Al-poor overlay coating from a component after the component has already been exposed to an oxidizing environment and the desire is to remove the overlay coating to permit inspection and repair of the component, the invention can also be used in circumstances in which an Al-poor overlay coating is to be removed from a component before the component is placed in service and exposed to an oxidizing environment, for example, if removal of the overlay coating is necessary to permit inspection and repair of the component during the original manufacturing process of the component. In either event, the resulting aluminum-infused overlay coating is stripped immediately after aluminum diffusion and before being placed in or returned to service, such that the purpose of the aluminum diffusion is not to enhance the oxidation resistance of the overlay coating as done in the prior art, but is instead to enable stripping of the overlay coating. Following stripping of the aluminum-infused overlay coating and any inspection or repair of the component, a new Al-poor overlay coating can be deposited on the component before returning the component to service, with the result that the component is protected by the new Al-poor overlay coating and not a diffusion-aluminided overlay coating.

In one embodiment, Al is diffused into an Al-poor coating by treating the Al-poor coating with a slurry which includes colloidal silica and particles of an aluminum-based powder. The term "colloidal silica" is meant to embrace any dispersion of fine particles of silica in a medium of water or another solvent. Dispersions of colloidal silica are available from various chemical manufacturers, in either acidic or basic form. Moreover, various shapes of silica particles can be used, e.g., spherical, hollow, porous, rod, plate, flake, or fibrous, as well as amorphous silica powder. Spherical silica particles are often utilized. The particles usually have an average particle size in the range of about 10 nanometers to about 100 nanometers.

The amount of colloidal silica present in the composition depends on various factors. The factors include, for example: the amount of aluminum-based powder being used; and the presence and amount of an organic stabilizer, as described below. Processing conditions are also a consideration, e.g., how the slurry is formed and applied to the coating. Usually, the colloidal silica is present at about 5% by weight to about 20% by weight, based on silica solids as a percentage of the entire composition. In some embodiments, the amount is in the range of about 10% by weight to about 15% by weight.

The slurry composition further includes an aluminum-based powder. This powder serves as the source of aluminum diffused into the coating. The aluminum-based powder can be obtained from a number of commercial sources, such as Valimet Corporation, Stockton, Calif. The powder is usually in the form of spherical particles. However, it can be in other forms as well, such as those described above for the colloidal silica, or in the form of a wire, e.g., wire mesh.

A variety of standard sizes of aluminum-based powder particles can be used. The size of the powder particles will depend on several factors, such as the type of coating; the technique by which the slurry is to be applied to the coating; the identity of the other components present in the slurry; and the relative amounts of those components. Usually, the powder particles have an average particle size in the range of about 0.5 micrometer to about 200 micrometers. In some embodiments, the powder particles have an average particle size in the range of about 1 micrometer to about 50 micrometers. In other embodiments, the average particle size is in the range of about 1 micrometer to about 20 micrometers. The powder particles are often produced by a gas atomization process, although other techniques can be employed, e.g., rotating electrode techniques.

As used herein, an "aluminum-based powder" is defined as one which contains at least about 75% by weight aluminum, based on total elements present. For example, the powder may contain at least one platinum group metal, such as platinum, palladium, ruthenium, rhodium, osmium, and iridium. Rare earth metals are also possible, e.g., lanthanides such as lanthanum, cerium, and erbium. Elements which are chemically similar to the lanthanides could also be included, such as scandium and yttrium. In some instances, it may also be desirable to include one or more of iron, chromium, and cobalt. Moreover, those skilled in the art understand that aluminum-based powder may also contain various other elements and other materials at impurity levels, e.g., less than about 1% by weight. Techniques for preparing powders formed from any combination of the optional elements described above are also well known in the art.

The composition of the aluminum-based powder and the composition of the slurry depend in large part on the amount of aluminum needed for application to the coating. The amount of aluminum in the slurry is often in the range of about 0.5% by weight to about 45% by weight. In other embodiments, the amount of aluminum is in the range of about 30% by weight to about 40% by weight. Depending on the particular requirements for the coating, i.e., its surface region, these aluminum levels may be adjusted.

In one embodiment, the aluminum is present in the form of an aluminum-silicon alloy. Frequently, the alloy is in powder form, and is available from companies like Valimet Corporation. Alloy powders of this type usually have a particle size in the range described above for the aluminum-based powders. They are often formed from a gas atomization process.

The silicon in the aluminum-silicon alloy serves, in part, to decrease the melting point of the alloy, thereby facilitating the aluminiding process, as described below. In some embodiments, the silicon is present in an amount sufficient to decrease the melting point of the alloy to below about 610° C. Usually, the silicon is present in the alloy in the range of about 1% by weight to about 20% by weight, based on the combined weight of the silicon and aluminum. In some other embodiments, the silicon is present at a level in the range of about 10% by weight to about 15% by weight.

As in the case of the powders described above, the aluminum-silicon alloys may also contain one or more other elements which impart a variety of desired characteristics. Examples include the platinum group metals; rare earth metals (as well as Sc and Y); iron, chromium, cobalt, and the like. Minor amounts of impurities are also sometimes present.

In another embodiment, the slurry includes an organic stabilizer in addition to the colloidal silica and the aluminum (or aluminum-silicon) component. The stabilizer is an organic compound which contains at least two hydroxyl groups. In other embodiments, the stabilizer contains at least three hydroxyl groups. Stabilizers which are water-miscible are also sometimes utilized, although this is often not a critical requirement. Moreover, a combination of two or more organic compounds could be used as the stabilizer.

A variety of organic compounds can be used as the stabilizer. Nonlimiting examples include alkane diols (sometimes referred to as "dihydroxy alcohols") such as ethanediol, propanediol, butanediol, and cyclopentanediol. (Some of these dihydroxy alcohols are referred to as "glycols," e.g., ethylene glycol, propylene glycol, and diethylene glycol). The diols can be substituted with various organic groups, i.e., alkyl or aromatic groups. Nonlimiting examples of the substituted versions include 2-methyl-1,2-propanediol; 2,3-dimethyl-2,3-butanediol; 1-phenyl-1,2-ethanediol; and 1-phenyl-1,2-propanediol. Another example of the organic stabilizer is glycerol, $C_3H_5(OH)_3$. The compound is sometimes referred to as "glycerin" or "glycerine." Glycerol can readily be obtained from fats, i.e., glycerides. Compounds containing greater than three hydroxy groups (some of which are referred to as "sugar alcohols") can also be used. As an example, pentaerythritol, $C(CH_2OH)_4$, can be a suitable stabilizer. Sorbitol and similar polyhydroxy alcohols represent other examples.

Various polymeric materials containing at least two hydroxy groups can also be employed as the organic stabilizer. Nonlimiting examples include various fats (glycerides), such as phosphatidic acid (aphosphoglyceride). Carbohydrates represent another broad class of materials that may be employed. The term "carbohydrate" is meant to include polyhydroxy aldehydes, polyhydroxy ketones, or compounds that can be hydrolyzed to them. The term includes materials like lactose, along with sugars, such as glucose, sucrose, and fructose. Many related compounds could also be used, e.g., polysaccharides like cellulose and starch, or components within the polysaccharides, such as amylose. Water-soluble derivatives of any of these compounds are also known in the art, and can be used herein. Based on factors such as cost, availability, and effectiveness, glycerols and dihydroxy alcohols like the glycols are often utilized as the organic stabilizer.

The amount of the organic stabilizer which should be used depends on various factors. The factors include: the specific type of stabilizer present; the hydroxyl content of the stabilizer; its water-miscibility; the effect of the stabilizer on the viscosity of the slurry composition; the amount of aluminum present in the slurry composition; the particle size of the aluminum; the surface-to-volume ratio of the aluminum particles; the specific technique used to prepare the slurry; and the identity of the other components which may be present in the slurry composition.

In some embodiments, the organic stabilizer is present in an amount sufficient to chemically stabilize the aluminum or aluminum-silicon component during contact with water or any other aqueous components. The term "chemically stabilize" is used herein to indicate that the slurry remains substantially free of undesirable chemical reactions. These are reactions which would increase the viscosity and/or the temperature of the composition to unacceptable levels. For example, unacceptable increases in temperature or viscosity are those which could prevent the slurry composition from being easily applied to the substrate, e.g., by spraying. Usually, the amount of organic stabilizer present in the slurry composition is in the range of about 0.1% by weight to about 20% by weight, based on the total weight of the composition. In other embodiments, the range is about 0.5% by weight to about 15% by weight.

As mentioned above, the slurry is usually aqueous. In other words, it includes a liquid carrier which is primarily water, i.e., the medium in which the colloidal silica is often disposed. As used herein, "aqueous" refers to compositions in which at least about 65% of the volatile components are water. In some embodiments, at least about 80% of the volatile components are water. Thus, a limited amount of other liquids may be used in admixture with the water. Nonlimiting examples of the other liquids or "carriers" include alcohols, e.g., lower alcohols with 1-4 carbon atoms in the main chain, such as ethanol. Halogenated hydrocarbon solvents are another example. Selection of a particular carrier composition will depend on various factors, such as: the evaporation rate required during treatment of the substrate with the slurry; the effect of the carrier on the adhesion of the slurry to the substrate; the solubility of additives and other components in the carrier; the "dispersability" of powders in the carrier; the carrier's ability to wet the coating and modify the rheology of the slurry; as well as handling requirements, cost requirements, and environmental/safety concerns. Those of ordinary skill in the art can select the most appropriate carrier composition by considering these factors.

The amount of liquid carrier employed is usually the minimum amount sufficient to keep the solid components of the slurry in suspension. Amounts greater than that level may be used to adjust the viscosity of the slurry, depending on the technique used to apply the slurry to the coating. In general, the liquid carrier will comprise about 30% by weight to about 70% by weight of the entire slurry.

A variety of other components may be used in the slurry. Most of them are well known in areas of chemical processing and ceramics processing. Nonlimiting examples of these additives are thickening agents, dispersants, deflocculants, anti-settling agents, anti-foaming agents, binders, plasticizers, emollients, surfactants, and lubricants. In general, the additives are used at a level in the range of about 0.01% by weight to about 10% by weight, based on the weight of the entire slurry.

For embodiments in which the slurry is based on colloidal silica and the aluminum-silicon alloy, there are no critical steps in preparing the slurry. Conventional blending equipment can be used, and the shearing viscosity can be adjusted by addition of the liquid carrier. Mixing of the ingredients can be unde 13 alcen at room temperature, or at temperatures up to about 60° C., e.g., using a hot water bath or other technique. Mixing is carried out until the resulting slurry is uniform. The additives mentioned above, if used, are usually added after the primary ingredients have been mixed, although this will depend in part on the nature of the additive.

For embodiments which utilize an organic stabilizer in conjunction with the aluminum-based powder and the colloidal silica, certain blending sequences are usually utilized. For example, the organic stabilizer is usually first mixed with the aluminum-based powder, prior to any significant contact between the aluminum-based powder and the aqueous carrier. A limited portion of the colloidal silica, e.g., one-half or less of the formulated amount, may also be included at this time (and added slowly), to enhance the shear characteristics of the mixture. The initial contact between the stabilizer and the aluminum, in the absence of a substantial amount of any aqueous component, greatly increases the stability of this type of slurry.

The remaining portion of the colloidal silica is then added and thoroughly mixed into the blend. The other optional additives can also be added at this time. In some instances, it may be desirable to wait for a period of time, e.g., up to about 24 hours or more, prior to adding the remaining colloidal silica. This waiting period may enhance the "wetting" of the alumina with the stabilizer, but does not always appear to be necessary. Those skilled in the art can determine the effect of the waiting period on slurry stability, without undue experimentation. Blending temperatures are as described above.

The sequence discussed above is applicable for slurries which utilize the organic stabilizer. However, other techniques for mixing the ingredients may be possible. For example, if all of the primary ingredients are mixed together rapidly, then adverse reactions between the aluminum component and the colloidal silica could be prevented or minimized. However, the process should be monitored very closely for the occurrence of sudden increases in temperature and/or viscosity.

The slurry can be applied to the coating by a variety of techniques known in the art. The slurry can be slip-cast, brush-painted, dipped, sprayed, poured, rolled, or spun-coated onto the coating, for example. Spray-coating is often the easiest way to apply the slurry to articles such as airfoils. The viscosity of the slurry can be readily adjusted for spraying, by varying the amount of liquid carrier used. Spraying equipment is well known in the art. Any spray gun for painting should be suitable, including manual or automated spray gun models, air-spray and gravity-fed models, and the like. Adjustments in various spray gun settings (e.g., for pressure and slurry volume) can readily be made to satisfy the needs of a specific slurry-spraying operation.

The slurry can be applied as one layer, or in multiple layers. Multiple layers may sometimes be required to deliver the desired amount of aluminum to the coating. If a series of layers is used, a heat treatment can be performed after each layer is deposited, to accelerate removal of the volatile components of the slurry. After the full thickness of the slurry has been applied, an additional, optional heat treatment may be carried out, to further remove volatile materials like organic solvents and water. The heat treatment conditions will depend in part on the identity of the volatile components in the slurry. An exemplary heating regimen is about 5 minutes to about 120 minutes, at a temperature in the range of about 80° C. to about 200° C. Longer heating times can compensate for lower heating temperatures, and vice-versa.

The dried slurry is then heated to a temperature sufficient to diffuse the aluminum into the desired portion of the coating, i.e., into the entire surface, or some portion thereof. The temperature required for this aluminizing step will depend on various factors, including: the composition of the coating and the substrate; the specific composition and thickness of the slurry; and the desired depth of enhanced aluminum concentration. Usually the diffusion temperature is within the range of about 650° C. to about 1100° C., with other embodiments utilizing a temperature of about 800° C. to about 950° C. These temperatures are also high enough to completely remove any organic compounds which are present, e.g., stabilizers like glycerol. The diffusion heat treatment can be carried out by any convenient technique, e.g., heating in an oven in a vacuum or under argon gas.

The time required for the diffusion heat treatment will depend on many of the factors described above. Generally, the time will range from about 30 minutes to about 8 hours. In some instances, a graduated heat treatment is desirable. As a very general example, the temperature could be raised to about 650° C., held there for a period of time, and then increased in steps to about to 850° C. Alternatively, the temperature could initially be raised to a threshold temperature like 650° C., and then raised continuously, e.g., 1° C. per minute, to reach a temperature of about 850° C. in 200 minutes. Those skilled in the general art (e.g., those who work in the area of pack-aluminizing) will be able to select the most appropriate time-temperature regimen for a given coating and slurry.

The process as described above is highly effective for diffusing aluminum into a pre-existing Al-poor coating to produce an increased aluminum level in at least an outer surface of the Al-poor coating, yielding what is termed herein an aluminum-infused coating. Diffusing aluminum into the Al-poor coating as described increases the Al-content of the coating sufficiently (to 12% by weight or more) to make the coating removable by a specific stripping process that advantageously does not interact negatively with the substrate. Hereby, the art is significantly benefitted in that costs are reduced and the service life of components is increased. The stripping process to be utilized with the newly aluminum-infused coating is detailed below.

An aqueous composition is employed to selectively strip the newly aluminum-infused coating from the substrate. The aqueous composition for some embodiments includes an acid having the formula $H_xAF_6$. In this formula, A is selected from the group consisting of Si, Ge, Ti, Zr, Al, and Ga. The subscript x is a quantity from 1 to 6, and more typically, from 1 to 3. Materials of this type are available commercially, or can be prepared without undue effort. In some embodiments, the acids $H_2SiF_6$ or $H_2ZrF_6$ are utilized. In other embodiments, $H_2SiF_6$ is utilized. The last-mentioned material is referred to by several names, such as "hydrofluosilicic acid," "fluorosilicic acid," and "hexafluorosilicic acid."

Precursors to the $H_xAF_6$ acid may also be used. As used herein, a "precursor" refers to any compound or group of compounds which can be combined to form the acid or its dianion $AF_6^{-2}$, or which can be transformed into the acid or its dianion under reactive conditions, e.g., the action of heat, agitation, catalysts, and the like. Thus, for example, the acid can be formed in situ in a reaction vessel.

As one illustration, the precursor may be a metal salt, an inorganic salt, or an organic salt in which the dianion is ionically bound. Nonlimiting examples include salts of Ag, Na, Ni, K, and $NH_4^+$ as well as organic salts, such as a quaternary ammonium salt. Dissociation of the salts in an aqueous solution yields the acid. In the case of $H_2SiF_6$, a convenient salt which can be employed is $Na_2SiF_6$.

Those skilled in the art are familiar with the use of compounds which cause the formation of $H_xAF_6$ within an aqueous composition. For example, $H_2SiF_6$ can be formed in situ by the reaction of a silicon-containing compound with a fluorine-containing compound. An example of a silicon-containing compound is $SiO_2$, while an example of a fluorine-containing compound is hydrofluoric acid (i.e., aqueous hydrogen fluoride).

When used as a single acid, the $H_xAF_6$ acid is effective for removing the coatings described above, without adversely affecting the substrate. Usually, the level of acid employed will depend on various factors such as the composition and amount of coating being removed, the location of the coating material on a substrate, the type of substrate, the thermal history of the substrate and coating (e.g., the level of interdiffusion), the technique by which the substrate is being exposed to the treatment composition, the time and temperature used for treatment, and the stability of the acid in solution.

In general, the $H_xAF_6$ acid is present in the aqueous composition at a level in the range of about 0.05 M to about 5 M, where M represents molarity. Usually, the level is in the range of about 0.2 M to about 3.5 M. In the case of $H_2SiF_6$, the concentration is often in the range of about 0.2 M to about 2.2 M. The amounts of $H_xAF_6$ acid and of other components described below can be readily adjusted by observing the effect of particular compositions on coating removal from the substrate.

The aqueous composition may contain at least one additional acid, i.e., in addition to the "primary" acid, $H_xAF_6$. The use of the additional acid sometimes enhances the removal of coating from less accessible areas of the substrate that are prone to depletion of the acidic solution. In some embodiments, the additional acid has a pH of less than about 3.5 in pure water. In other embodiments, the additional acid has a pH which is less than the pH (in pure water) of the primary acid, i.e., the $H_xAF_6$ material. Thus, in the case of $H_2SiF_6$, the additional acid may be one having a pH of less than about 1.3.

Various types of acids may be used as the additional acid, e.g., a mineral acid or an organic acid. Nonlimiting examples include phosphoric acid, nitric acid, sulfuric acid, hydrochloric acid, hydrofluoric acid, hydrobromic acid, hydriodic acid, acetic acid, perchloric acid, phosphorous acid, phosphinic acid, alkyl sulfonic acids (e.g., methanesulfonic acid), and mixtures of any of the foregoing. Those skilled in the art can select the most appropriate additional acid, based on observed effectiveness and other factors, such as availability, compatibility with the primary acid, cost, and environmental considerations. Moreover, a precursor of the acid may be used (e.g., a salt), as described above in reference to the primary acid. In some embodiments of this invention, the additional acid is selected from the group consisting of phosphoric acid, nitric acid, sulfuric acid, hydrochloric acid, hydrofluoric acid, and mixtures thereof. In other embodiments (e.g., when the primary acid is $H_2SiF_6$), the additional acid may be phosphoric acid.

The amount of additional acid employed will depend on the identity of the primary acid, and on many of the factors set forth above. Usually, the additional acid is present in the composition at a level of about 0.1 M to about 20 M. In some embodiments (e.g., in the case of phosphoric acid), the range is from about 0.5 M to about 5 M. Furthermore, other embodiments include the additional acid at a level of about 2 M to about 4 M. Longer treatment times and/or higher treatment temperatures may compensate for lower levels of the acid, and vice versa. Experiments can be readily carried out to determine the most appropriate level for the additional acid.

The aqueous composition may include various other additives which serve a variety of functions. Nonlimiting examples of these additives are inhibitors, dispersants, surfactants, chelating agents, wetting agents, deflocculants, stabilizers, anti-settling agents, and anti-foam agents. Those of ordinary skill in the art are familiar with specific types of such additives, and with effective levels for their use. An example of an inhibitor for the composition is a relatively weak acid like acetic acid, mentioned above. Such a material tends to lower the activity of the primary acid in the composition. This is desirable in some instances, e.g., to decrease a potential for pitting of the substrate surface.

Various techniques can be used to treat the article with the aqueous composition. For example, the article can be continuously sprayed with the composition, using various types of spray guns. A single spray gun could be employed. Alternatively, a line of guns could be used, and the article could pass alongside or through the line of guns (or multiple lines of guns). In another alternative embodiment, the coating removal composition could be poured over the article (and continuously recirculated).

In some embodiments, the article is immersed in a bath of the aqueous composition. Immersion in this manner (in any type of vessel) often permits the greatest degree of contact between the aqueous composition and the coating which is being removed. Immersion time and bath temperature will depend on many of the factors described above, such as the type of coating being removed, and the acid (or acids) being used in the bath. Usually, the bath is maintained at a temperature in the range of about room temperature to about 100° C. while the substrate is immersed therein. In other embodiments, the temperature is maintained in the range of about 45° C. to about 90° C. The immersion time may vary considerably, but is usually in the range of about 10 minutes to about 72 hours, and in some embodiments, from about 1 hour to about 20 hours. Longer immersion times may compensate for lower bath temperatures. After removal from the bath (or after contact of the coating by any technique mentioned above), the substrate is typically rinsed in water, which also may contain other conventional additives, such as a wetting agent.

One embodiment includes an electrochemical stripping system to accelerate removal of the coating from the substrate. FIG. 1 schematically illustrates such a system 10, which includes an electrolyte bath receptacle 12. The bath contains electrolyte 14, e.g., an aqueous composition of $H_xAF_6$, along with one or more of the other additives described previously. The electrolyte bath receptacle 12 is formed of any suitable material which is nonreactive with any of the bath components. The shape and capacity of the receptacle 12 may vary according to the application, as long as the receptacle 12 is sized sufficiently to accommodate the electrodes and electrolyte 14. The electrochemical stripping system of this invention includes at least one electrode. Two electrodes, 16 and 18, are depicted in FIG. 1. The number of electrodes will vary, depending on various factors, such as the size and shape of the article being treated. Each electrode, 16 and 18, is formed with an appropriate geometry that is configured to direct electrical fields to surfaces of an article 20 at least partially coated with an aluminum-infused overlay coating produced by the process of this invention. The electrodes 16 and 18 are generally nonconsumable and remain intact throughout the electrochemical stripping process.

The article 20, which is to be stripped by the electrochemical stripping system 10, is disposed in the receptacle 12. The article 20 is disposed between the electrodes 16 and 18, and positioned so that an electric field can be established between the electrodes 16 and 18 and the selected coated surfaces of the article 20. The electrolyte 14 is delivered to the receptacle 12 in amounts sufficient to submerge parts of the article.20 and electrodes 16 and 18. If a portion 22 of the article 20, e.g., a dovetail section of a turbine component, does not require stripping, this portion 22 may be kept above the level of the electrolyte 14. Alternatively, this portion 22 can be physically masked so as to shield the electric field. A further alternative is to minimize the electric field over this portion 22, for example, by modifying the locations of electrodes 16 and 18. The portions 22 that are to be electrochemically stripped should be submerged in the electrolyte 14.

A power supply 24 establishes an electric field in the electrochemical stripping system. The power supply 24 is usually direct current (DC), with a switching-mode capability. It is often operated in the constant potential mode. Power supply 24 carries current over connections 26, 28 and 30, to the electrodes 16 and 18. The electrodes 16 and 18 are connected to the negative terminals of the power supply 24. The stripping of the coating from article 20 comprises the electrolyte 14 reacting with the coating. The electrolyte 14 carries a charge to article 20, and under the action of the electric current, the coating is stripped from the article 20.

Various parameters define the stripping characteristics for this embodiment. These parameters influence the rate of material removal and thus, the efficiency of the stripping process. Nonlimiting, exemplary parameters are: electrode geometry, power supply voltage or current (dependent on parameters being controlled), electrolyte concentrations, solvent composition, use of agitation, processing time, distance between the article 20 and electrodes 16 and 18, and temperature of the electrolyte 14. Those who are familiar with electrochemical machining techniques would be familiar with many of the stripping parameters which relate to this embodiment.

The stripping parameters may vary over operational ranges. For example, a DC power supply 24 voltage may vary from a trace voltage (the term "trace" means a small but measurable value) to about 30V. The electrical current is sometimes pulsed to allow charged ionic byproducts to leave the electrode boundary layers. However, pulsed power application is not critical for this embodiment. The distance between the article 20 and the electrodes 16 and 18 typically varies in a range from about 0.1 inch (about 0.25 cm) to about 10 inches (about 25.4 cm).

The temperature of the electrolyte 14 can be maintained up to about 100° C. In some embodiments, the temperature is maintained below about 50° C., and in other embodiments, the temperature range is from about 5° C. to about 30° C.

The stripping time (i.e., the immersion time within the electrolyte) may vary considerably. Factors which influence the selection of an appropriate time include the composition of the coating being removed, as well as its microstructure, density, and thickness. The electrochemical stripping time may increase with higher density and thicker coatings. Usually, the time will range from about 1 minute to about 36 hours, and in some cases, from about 5 minutes to about 8 hours. In some other instances, the immersion time is in the range of about 10 minutes to about 3 hours.

Usually, the substrate is a metallic material. As used herein, "metallic" refers to substrates which are primarily formed of metal or metal alloys, but which may also include some nonmetallic components. Nonlimiting examples of metallic materials are those which comprise at least one element selected from the group consisting of iron, cobalt, nickel, aluminum, chromium, titanium, and mixtures which include any of the foregoing (e.g., stainless steel).

Very often, the metallic material is a superalloy. Such materials are known for high-temperature performance, in terms of tensile strength, creep resistance, oxidation resistance, and corrosion resistance. The superalloy is typically nickel-, cobalt-, or iron-based, although nickel- and cobalt-based alloys are favored for high-performance applications. The base element, typically nickel or cobalt, is the single greatest element in the superalloy by weight. Illustrative nickel-base superalloys include at least about 40% Ni by weight, and at least one component from the group consisting of cobalt, chromium, aluminum, tungsten, molybdenum, titanium, and iron. Illustrative cobalt-base superalloys include at least about 30% Co by weight, and at least one component from the group consisting of nickel, chromium, tungsten, molybdenum, tantalum, manganese, carbon, and iron.

The actual configuration of a substrate may vary widely. As a general illustration, the substrate may be in the form of a houseware item (e.g., cookware), or a printed circuit board substrate. In many embodiments, superalloy substrates are in the form of combustor liners, combustor domes, shrouds, or airfoils. Airfoils, including buckets or blades, and nozzles or vanes, are typical substrates that are stripped according to embodiments of the invention. The invention is useful for removing coatings from the flat areas of substrates, as well as from curved or irregular surfaces which may include indentations, hollow regions, or holes (e.g., film cooling holes).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of removing an aluminum-containing overlay coating from a substrate of a gas turbine component, the overlay coating having an aluminum content of less than 12% by weight and being highly resistant to selective stripping, the method comprising:

removing the component from a gas turbine after operation of the gas turbine and after growth of a protective alumina scale on an exposed outer surface of the overlay coating;

diffusing aluminum into the overlay coating to form an aluminum-infused overlay coating having an increased aluminum level in at least an outer surface thereof, the increased aluminum level being sufficient to render the aluminum-infused overlay coating removable by selective stripping; and then contacting the outer surface of the aluminum-infused overlay coating With an aqueous composition to remove the aluminum-infused overlay coating from the substrate, the aqueous composition including at least one of an acid having the formula HxAF6, and precursors to said acid, A being selected from the group consisting of Si, Ge, Ti, Zr, Al, and Ga, and x being 1 to 6.

2. The method according to claim 1, wherein the metallic material is a superalloy.

3. The method according to claim 1, wherein the component is not installed on a gas turbine after the diffusing step and before the contacting step.

4. The method according to claim 2, wherein the superalloy is nickel-based or cobalt-based superalloy.

5. The method according to claim 3, further comprising:

after the contacting step and removal of the aluminum-infused overlay coating, depositing a second Al-poor overlay coating on the substrate of the component; and then installing the component on a gas turbine so that the component is protected by the second Al-poor overlay coating and not the aluminum-infused overlay coating or a diffusion-aluminided overlay coating.

* * * * *